US006510956B2

(12) United States Patent
Therber

(10) Patent No.: US 6,510,956 B2
(45) Date of Patent: Jan. 28, 2003

(54) DISPLAY STAND

(76) Inventor: Darlene D. Therber, 5061 English Village Dr., Nashville, TN (US) 37211

( * ) Notice: Subject to any disclaimer, the term of this patent is extended or adjusted under 35 U.S.C. 154(b) by 0 days.

(21) Appl. No.: 09/745,196

(22) Filed: Dec. 21, 2000

(65) Prior Publication Data

US 2001/0025825 A1 Oct. 4, 2001

Related U.S. Application Data

(63) Continuation of application No. 09/037,554, filed on Mar. 9, 1998, now abandoned.

(51) Int. Cl.[7] ..... A47B 43/00
(52) U.S. Cl. ..... 211/205; 211/196
(58) Field of Search ..... 211/205, 163, 211/196, 13.1, 88.01, 188, 128.1, 126.3, 49.1, 56, 85.4; 248/91, 93, 94; 206/558; D6/407; D2/830; D19/77; D7/610

(56) References Cited

U.S. PATENT DOCUMENTS

| | | | | | |
|---|---|---|---|---|---|
| 737,367 | A | * | 8/1903 | Dieringer et al. | 273/112 |
| 1,268,245 | A | * | 6/1918 | Hoiland | 108/32 |
| 1,959,736 | A | * | 5/1934 | Rademacher | 209/697 |
| 2,108,002 | A | * | 2/1938 | Smith et al. | 40/440 |
| D133,432 | S | * | 8/1942 | Booher | D6/450 |
| D140,828 | S | * | 4/1945 | Rosner | D6/408 |
| 2,634,128 | A | * | 4/1953 | Reed | 273/120 R |
| 3,703,989 | A | * | 11/1972 | Tomiyama | 238/10 E |
| 4,145,731 | A | * | 3/1979 | Adamich | 362/123 |
| 4,428,988 | A | * | 1/1984 | Adinamis | 428/8 |
| D277,205 | S | * | 1/1985 | Suzuki et al. | D21/143 |
| 4,585,166 | A | * | 4/1986 | Stephens | 238/10 R |
| 4,746,022 | A | * | 5/1988 | Benham | 211/195 |
| D296,489 | S | * | 6/1988 | Nair | D34/28 |
| 4,790,531 | A | * | 12/1988 | Matsui et al. | 472/90 |
| D305,556 | S | * | 1/1990 | Lo | D21/143 |
| 5,336,536 | A | * | 8/1994 | Oberzan | 428/8 |
| D352,742 | S | * | 11/1994 | Koch | D21/104 |
| 5,542,550 | A | * | 8/1996 | Kakavoulis-Perera et al. | 211/40 |
| D408,319 | S | * | 4/1999 | Byers | D11/118 |
| 5,975,317 | A | * | 11/1999 | Roebling | 211/45 |
| 6,048,590 | A | * | 4/2000 | Phillips | 428/9 |
| 6,139,168 | A | * | 10/2000 | Gary et al. | 362/252 |

* cited by examiner

*Primary Examiner*—Daniel P. Stodola
*Assistant Examiner*—Khoa Tran
(74) *Attorney, Agent, or Firm*—Waddey & Patterson; Lucian Wayne Beavers

(57) ABSTRACT

Methods of manufacturing a three-dimensional helically-shaped display stand, and cake combination, and the stand and cake combination manufactured by such methods. From a base to an apex, a helically-shaped display rises. This helix can be cut from a single disc of material and can be supported in a variety of ways from the base.

3 Claims, 1 Drawing Sheet

DISPLAY STAND

This application is a continuation of my U.S. patent application Ser. No. 09/037,554 for "DISPLAY STAND" filed Mar. 9, 1998, now abandoned, the details of which are incorporated herein by reference.

BACKGROUND OF THE INVENTION

The present invention relates generally to a display stand and more particularly to a helically shaped stand for displaying items such as cakes, candles, flowers, cookies, chips, vegetables, fruit, pastries, candies, and the like.

It will be appreciated by those skilled in the art that standard cakes, candles, flowers, and the like look better when displayed in different and ornamental methods. The prior art has several different types of displaying such materials. U.S. Pat. No. 1,570,651 issued to W. Topping, et al on Jan. 26, 1926, discloses a multi-tiered circular display. A similar display is disclosed in U.S. Pat. Nos. 3,169,496 and 3,951,079. Other displays are shown in U.S. Pat. Nos. 3,115,253; 4,096,772; 4,311,237; 4,539,914; 4,823,966; and 5,572,936. Unfortunately, each of these displays require multiple individual levels. Additionally, each of these displays requires that the entire tier or disc be filled in order to present a pleasing display. In other words, if a tier is not filled, then the viewers of the display would see the tier. However, filling the entire tier can be very expensive. Additionally, if consumers see the tier as opposed to the material on the tier, they will feel like they have been short changed.

What is needed, then, is a new display. This needed display must be simple to manufacture. This needed display must be economical to manufacture. This needed display must be able to present a material in an economical way. This needed display must be capable to displaying in a nice ornamental way. This display is presently lacking in the prior art.

SUMMARY OF THE INVENTION

The present invention discloses a three-dimensional helically shaped display stand. From a base to a apex, a helically shaped display rises. This helix can be cut out of a single disc of material and can be supported in a variety of ways such as multiple external supports placed along an underside or a single internal support through the center of the helix up toward the apex r top of the base.

Accordingly, one object of the present invention is to provide a shaped-shaped display stand.

Another object of the present invention is to provide a display stand that is simple and economic to manufacture.

Another object of the present invention is to provide a display stand which is economical to cover with the materials to be displayed.

Another object of the present invention is to provide an ornamentally pleasing display.

Another object of the present invention is to provide a display of an item such as a cake which spreads a sheeted cake over a three-dimensional area thereby making a single sheet appear bigger thereby allowing the sheet of cake to be presented in a new manner.

DETAILED DESCRIPTION OF THE PREFERRED EMBODIMENTS

Figure 1:
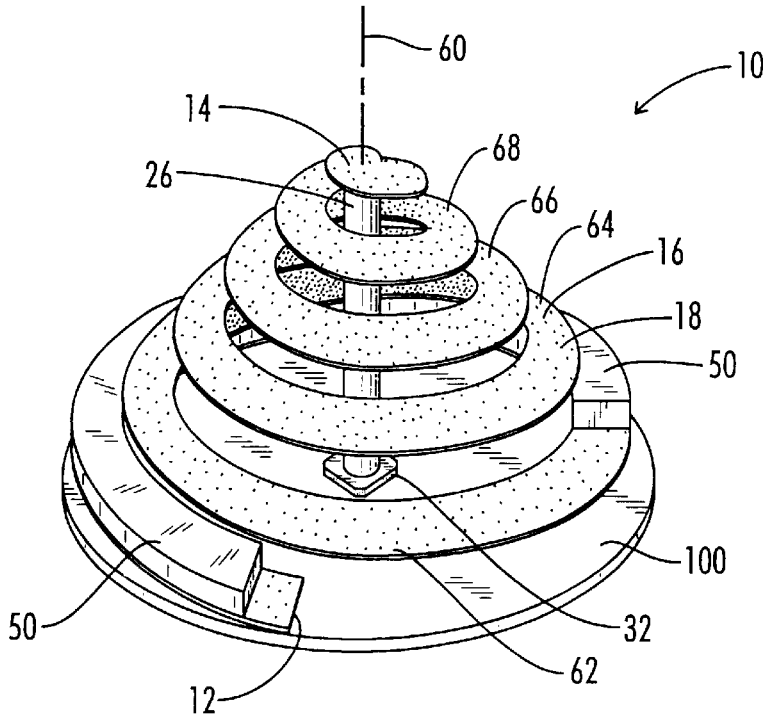
FIG. 1 is a perspective view of the display stand illustrating in partially cutaway view a portion of a spiral sheet cake in place upon the display stand.
Figure 2:
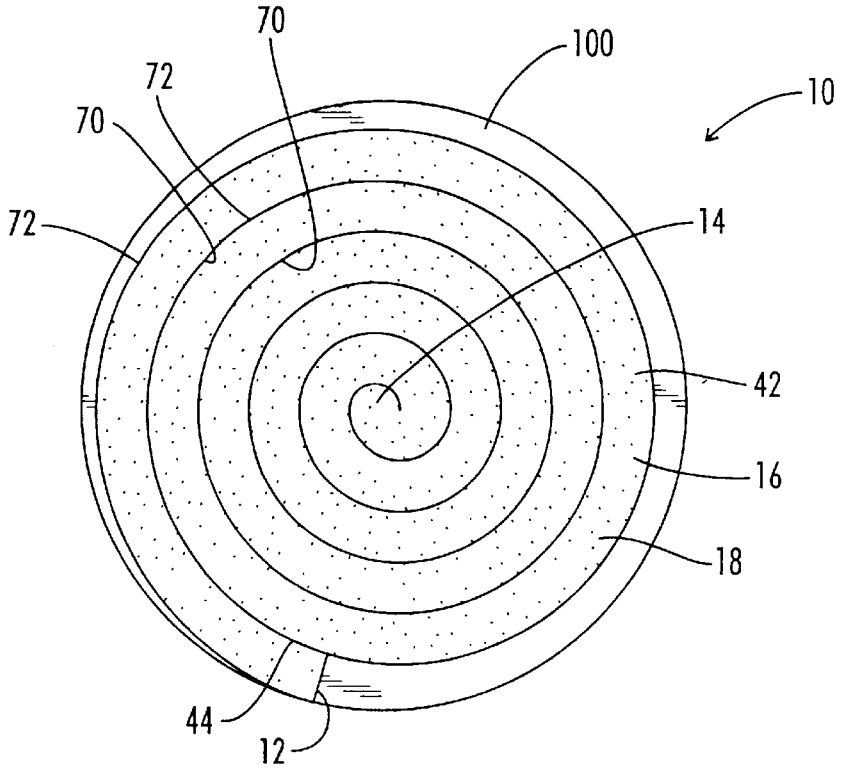
FIG. 2 is a plan view of the display stand of FIG. 1.

Referring now to FIGS. 1 and 2, the display stand of the present invention is shown and generally designated by the numeral 10. The display stand 10 includes a helically shaped display 16 rising from a base or lowermost end 12 to an apex or uppermost end 14. A support column 26 rises through the middle of the display 16 from a base plate 100 up to apex 14. Apex 14 can also be described as the proximal top 14 of the display 16. A support block 32 supports the lower end of support column 26 upon the base plate 100 to steady the support column 26. Any necessary additional support members (not shown) may be added extending from the base plate 100 to the various spiral loops of the display 16 to aid in supporting the display 16 in the spiral orientation illustrated.

Referring now to the plan view of FIG. 2, it is there seen that the spiral display 16 is formed from a generally disc-shaped sheet of material 42 in which a spiral cut 44 has been made. The spiral cut 44 extends between a location near the center of the sheet 42 and an outer edge of sheet 42. After the spiral cut 44 is made, while securing the base or lowermost end 12 such as to base plate 100, the apex 14 is pulled upward thereby creating the helically shaped display 16. Display 16 may also be described as an upwardly tapered spiral shelf 16.

This results in a spiral shelf having a continuous planar upward facing surface 18 extending from the lowermost end 12 to the uppermost end 14 and extending around a central axis 60 of display stand 10 in a plurality of loops such as 62, 64, 66 and 68. The upper surface 18 has radially inner and outer edges 70 and 72, respectively, which are best shown in FIG. 2. The inner and outer edges 70 and 72 decrease in radius from the lowermost end 12 to the uppermost end 14. At any point along the length of the spiral shaped display shelf 16, the inner edge 70 of the upward facing surface 18 is substantially vertically aligned with the outer edge 72 of the next spiral loop of the shelf 16 located thereabove.

Without limitation, the spiral display 16 may be made of any sufficiently rigid material to support whatever is being displayed either with or without a support system. For example, the display 16 can be made of cardboard, wood, plexiglas, tile board, copper coil, and rod iron.

Additionally, support walls (not shown) can be added around the edge of the spiral display to aid in retaining small items such as small individual cupcakes, candies or the like on the spiral display 16.

The display stand 10 can be utilized to display any desired articles, including, without limitation, candles, fruit, flowers, cookies, pastries, candies, cakes, chips and fresh vegetables. One preferred use of the display stand 10 is for the display of a spiral shape sheet cake 50, a portion of which is illustrated in FIG. 1. This allows the sheet cake 50 to be spread over a three-dimensional area, thus making a single sheet of cake appear bigger thereby allowing the sheet cake 50 to be presented in a new manner.

In FIG. 1, only a portion of the spiral shape cake 50 is shown, so that the underlying spiral shaped display stand may be clearly illustrated. As is apparent in FIG. 1, however, the cake 50 will include multiple continuous spiral loops of cake decreasing in radius from a lowermost end to an uppermost end. The lowermost end of the cake will be coterminous with and overlie lowermost end 12 of display 16, and the uppermost end of the cake will be coterminous with and overlie the apex 14 of the spiral support stand 16.

Thus, there have been described a novel spiral-shaped display stand, and display stand and cake combination, along with methods of constructing the same. While particular embodiments of the invention have been illustrated and described for purposes of the present disclosure, it is not intended that such references be construed as limitations upon the scope of this invention, except as set forth in the following claims. Numerous changes in the arrangement and construction of parts and steps may be made by those skilled in the art with such changes are encompassed within the scope and spirit of the present invention as defined by the appended claims.

What is claimed is:

1. A method of constructing a display stand and cake, comprising:

(a) providing a planar sheet of material;

(b) making a spiral cut in said sheet, the spiral cut extending between a location near a center of said sheet and an outer edge of the sheet;

(e) attaching an outer portion of the sheet to a base;

(d) extending a center portion of the sheet upward relative to the outer portion so that the sheet forms an upwardly tapered spiral shelf extending from the base; and (e) placing a sheet cake upon the spiral shelf so that the sheet cake is displayed as a three-dimensional spiral sheet cake.

2. The method of claim 1, further comprising:

supporting the center portion of the sheet relative to the base so that the center portion defines an apex of the display stand.

3. The method of claim 1, further comprising:

placing the cake upon the spiral shelf so that the cake includes multiple continuous spiral loops of cake decreasing in radius from a lowermost end to an uppermost end of the cake.

* * * * *

UNITED STATES PATENT AND TRADEMARK OFFICE

CERTIFICATE OF CORRECTION

PATENT NO. : 6,510,956 B2
DATED : January 28, 2003
INVENTOR(S) : Therber

It is certified that error appears in the above-identified patent and that said Letters Patent is hereby corrected as shown below:

Title page,
Item [57], ABSTRACT,
Line 2, before "cake" insert -- a stand and --;
Line 6, replace "the" with -- a --.

Column 1,
Line 43, replace "r" with -- or --.

Column 3,
Line 12, replace "(e)" with -- (c) --.

Signed and Sealed this

First Day of July, 2003

JAMES E. ROGAN
*Director of the United States Patent and Trademark Office*